US007576524B2

(12) United States Patent
Ohoka

(10) Patent No.: US 7,576,524 B2
(45) Date of Patent: Aug. 18, 2009

(54) CONSTANT VOLTAGE GENERATING APPARATUS WITH SIMPLE OVERCURRENT/SHORT-CIRCUIT PROTECTION CIRCUIT

(75) Inventor: Tsukasa Ohoka, Shiga (JP)

(73) Assignee: NEC Electronics Corporatioon, Kawasaki, Kangawa (JP)

( * ) Notice: Subject to any disclaimer, the term of this patent is extended or adjusted under 35 U.S.C. 154(b) by 322 days.

(21) Appl. No.: 11/591,518

(22) Filed: Nov. 2, 2006

(65) Prior Publication Data

US 2007/0108949 A1 May 17, 2007

(30) Foreign Application Priority Data

Nov. 11, 2005 (JP) ..... 2005-327196

(51) Int. Cl.
*G05F 1/565* (2006.01)

(52) U.S. Cl. ..... 323/275; 323/281

(58) Field of Classification Search ..... 323/273, 323/275, 281, 313, 315, 316
See application file for complete search history.

(56) References Cited

U.S. PATENT DOCUMENTS 6,917,187 B2 * 7/2005 Okubo et al. ..... 323/275
7,030,686 B2 * 4/2006 Itoh ..... 327/541
7,274,251 B2 * 9/2007 Yang ..... 327/543
7,411,376 B2 * 8/2008 Zhang ..... 323/277
2002/0118002 A1 * 8/2002 Luo ..... 323/316
2005/0083027 A1 * 4/2005 Kikuchi ..... 323/287
2006/0113972 A1 * 6/2006 Mihara ..... 323/273
2006/0170401 A1 * 8/2006 Chen et al. ..... 323/273
2008/0197829 A1 * 8/2008 Nagata et al. ..... 323/316

FOREIGN PATENT DOCUMENTS

JP 2002-169618 6/2002

* cited by examiner

*Primary Examiner*—Jeffrey L Sterrett
(74) *Attorney, Agent, or Firm*—McGinn IP Law Group, PLLC

(57) ABSTRACT

In a constant voltage generating apparatus where an output circuit is controlled in accordance with a control voltage, a voltage detection signal generating circuit generates a voltage detection signal in accordance with a difference between an output voltage signal of the output circuit and a first reference signal. A current detection signal generating circuit generates a current detection signal in accordance with a difference between an output current signal of the output circuit and a second reference signal. A control current generating circuit generates a control current in accordance with the voltage detection signal and the current detection signal. A control current-to-control voltage converting circuit converts the control current into the control voltage.

19 Claims, 8 Drawing Sheets

| | Q1 | Q2 | CHARACTERISTIC |
|---|---|---|---|
| I | OFF | OFF | Fig. 2A |
| II | OFF | ON | Fig. 2B |
| III | ON | ON | Fig. 2C |

CONSTANT VOLTAGE GENERATING APPARATUS WITH SIMPLE OVERCURRENT/SHORT-CIRCUIT PROTECTION CIRCUIT

BACKGROUND OF THE INVENTION

1. Field of the Invention

The present invention relates to a constant voltage generating apparatus with a simple overcurrent/short-circuit protection circuit.

2. Description of the Related Art

Generally, a first prior art constant voltage generating apparatus is constructed by an output transistor connected between an input terminal and an output terminal, and a voltage detection signal generating circuit serving as a constant voltage control circuit connected between the output terminal and a ground terminal to control the output transistor. For example, the voltage detection signal generating circuit is formed by a voltage divider connected between the output terminal and the ground terminal, and an error amplifier for receiving a divided voltage from the voltage divider and a reference voltage to generate a voltage detection signal for controlling the output transistor, so that an output voltage at the output terminal is brought close to a constant voltage defined by the reference voltage. This will be explained later in detail.

In the above-described first prior art constant voltage generating apparatus, however, if the output terminal is short-circuited via a load or the like to the ground terminal, an overcurrent may flow through the output transistor, so that the output transistor may be heated and destroyed.

In order to avoid such an overcurrent, a second prior art constant voltage generating apparatus is usually provided with an overcurrent/short-circuit protection circuit (see: JP-2002-169618 A) in addition to the elements of the first prior art constant voltage generating apparatus. This also will be explained later in detail.

SUMMARY OF THE INVENTION

In the above-described second prior art second constant voltage generating apparatus, however, a drooping type current limiting circuit and a fold-back type current limiting circuit are individually provided as the overcurrent/short-circuit protection circuit. As a result, the circuit structure of the constant current generating apparatus is complex, which would increase the manufacturing cost.

Also, since a capacitance of the output transistor is very large, the response characteristics of the constant voltage generating apparatus would deteriorate.

According to the present invention, in a constant voltage generating apparatus where an output circuit is controlled in accordance with a control voltage, a voltage detection signal generating circuit generates a voltage detection signal in accordance with a difference between an output voltage signal of the output circuit and a first reference signal. A current detection signal generating circuit generates a current detection signal in accordance with a difference between an output current signal of the output circuit and a second reference signal. A control current generating circuit generates a control current in accordance with the voltage detection signal and the current detection signal. A control current-to-control voltage converting circuit converts the control current into the control voltage.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENTS

Before the description of the preferred embodiments, prior art constant voltage generating apparatuses will be explained with reference to FIGS. 1, 2A, 2B, 2C and 3.

Figure 1:
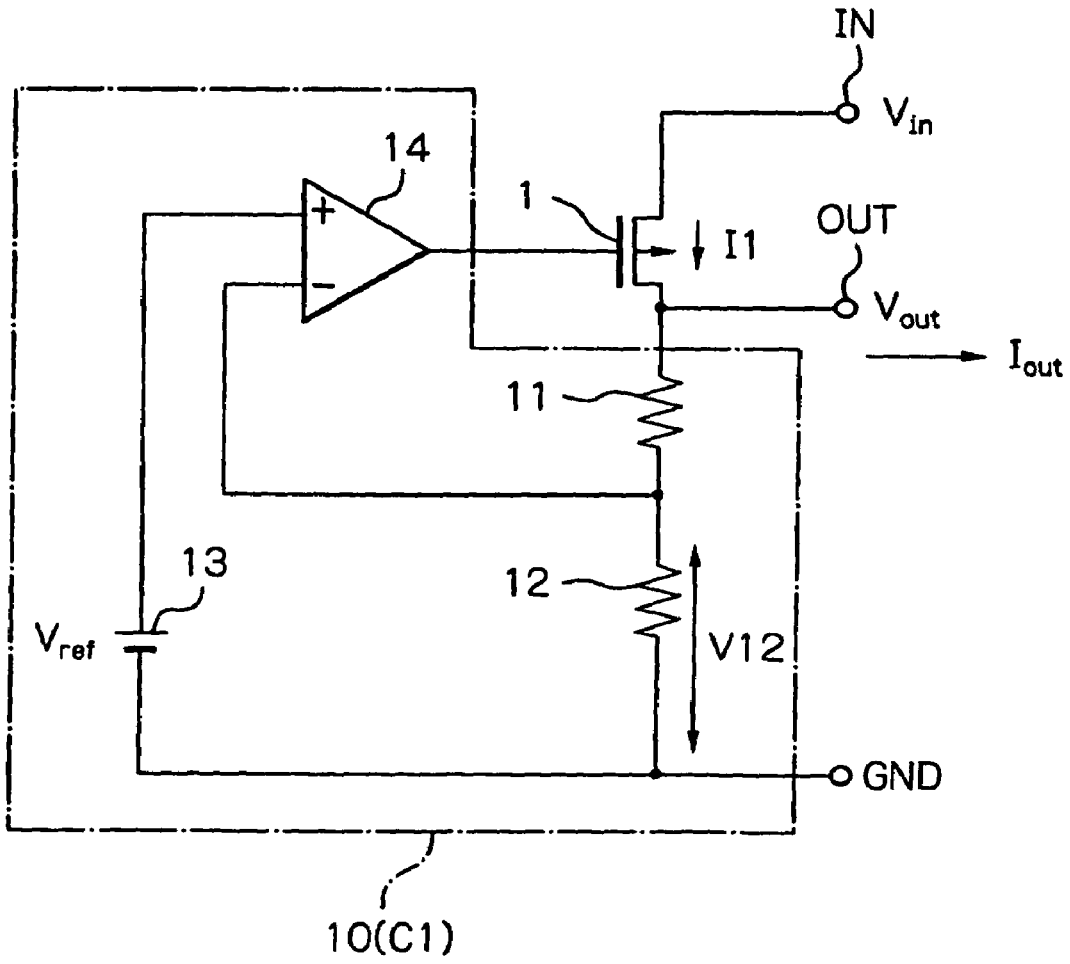
Fig. 1 PRIOR ART
FIG. 1 is a circuit diagram illustrating a first prior art constant voltage generating apparatus.

In FIG. 1, which illustrates a first prior art constant voltage generating apparatus, an input voltage $V_{in}$ and a voltage of 0V are applied to an input terminal IN and a ground terminal GND, respectively. Also, an output p-channel MOS transistor 1 is connected between the input terminal IN and an output terminal OUT. Further, a voltage detection signal generating circuit 10 serving as a constant voltage control circuit C1 is connected between the output terminal OUT and the ground terminal GND to control the output MOS transistor 1.

The voltage detection signal generating circuit 10 is constructed by a voltage divider formed by resistors 11 and 12 connected in series between the output terminal OUT and the ground terminal GND, a reference voltage source 13 and an error amplifier 14 formed by an operational amplifier.

Note that an output voltage and an output current at the output terminal OUT are defined by $V_{out}$ and $I_{out}$, respectively.

The ON-current of the output MOS transistor 1 is controlled by the error amplifier 14 which has a non-inverting input receiving a reference voltage $V_{ref}$ from the reference voltage source 13 and an inverting input receiving a divided voltage V12 of the output voltage $V_{out}$ by the resistors 11 and 12. In this case, the resistance values of the resistors 11 and 12 are so large that most of a current I1 flowing through the output MOS transistor 1 forms the output current $I_{out}$. As a result, the error amplifier 14 generates an error voltage between the divided voltage V12 and the reference voltage $V_{ref}$ as a voltage detection signal for controlling the output MOS transistor 1, so that the output voltage $V_{out}$ is brought close to a limit voltage $V_m$ defined by $$V_{out}=V_m=V_{ref}(R11+R12)/R12$$

where R11 and R12 are resistance values of the resistors 11 and 12, respectively.

In the constant voltage generating apparatus of FIG. 1, however, if the output terminal OUT is short-circuited via a load (not shown) or the like to the ground terminal GND, an overcurrent may flow through the output MOS transistor 1, so that the output MOS transistor 1 may be heated and destroyed. Therefore, an overcurrent protection function and a short-circuit protection function are required.

The overcurrent protection function is provided to prevent the output current $I_{out}$ from exceeding a limit current $I_m$. On the other hand, the short-circuit protection function is provided to decrease the output current $I_{out}$ to a short-circuit current $I_s$ to suppress the heating of the output MOS transistor, when the output terminal OUT is short-circuited to the ground terminal GND.

Figure 2A:
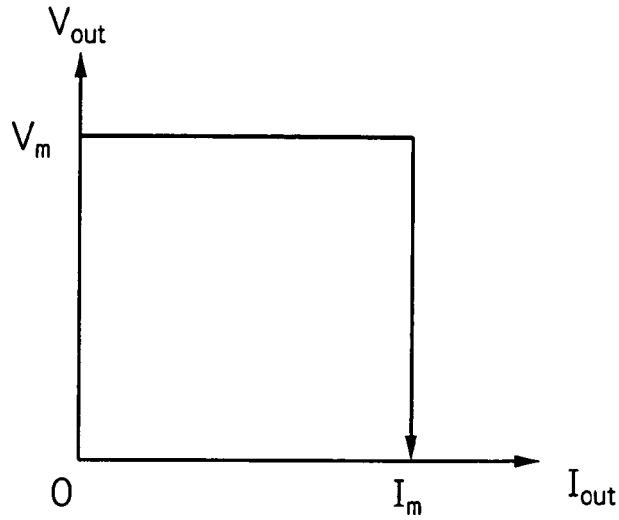
Fig. 2A PRIOR ART
FIG. 2A is a graph for explaining a drooping type current limiting characteristic required for the constant voltage generating apparatus of FIG. 1.

The overcurrent protection function is realized by a drooping type current limiting characteristic as shown in FIG. 2A. Also, the overcurrent protection function and the short-circuit protection function are realized by a fold-back (chevron) type current limiting characteristic as shown in FIG. 2B, or a drooping/fold-back type current limiting characteristic as shown in FIG. 2C.

In the drooping type current limiting characteristic of FIG. 2A, the output voltage $V_{out}$ is $V_m$ before the output current $I_{out}$ reaches the limit current $I_m$. When the output current $I_{out}$ reaches the limit current $I_m$, the output voltage $V_{out}$ is forcibly decreased to 0V while the output current $I_{out}$ remains at the limit current $I_m$.

Figure 2B:
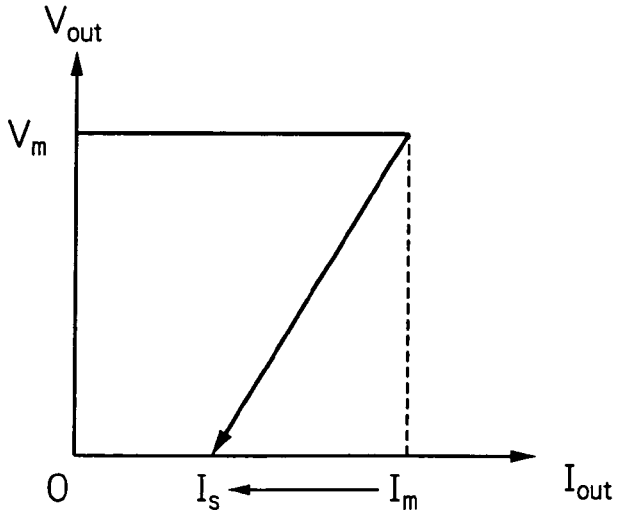
Fig. 2B PRIOR ART
FIG. 2B is a graph for explaining a fold-back (chevron) type current limiting characteristic required for the constant voltage generating apparatus of FIG. 1.

In the fold-back (chevron) type current limiting characteristic of FIG. 2B, the output voltage $V_{out}$ is the limit voltage $V_m$ before the output current $I_{out}$ reaches the limit current $I_m$. When the output current $I_{out}$ reaches the limit current $I_m$, the output voltage $V_{out}$ is gradually decreased to 0V and simultaneously, the output current $I_{out}$ is gradually decreased to the short-circuit current $I_s$.

Figure 2C:
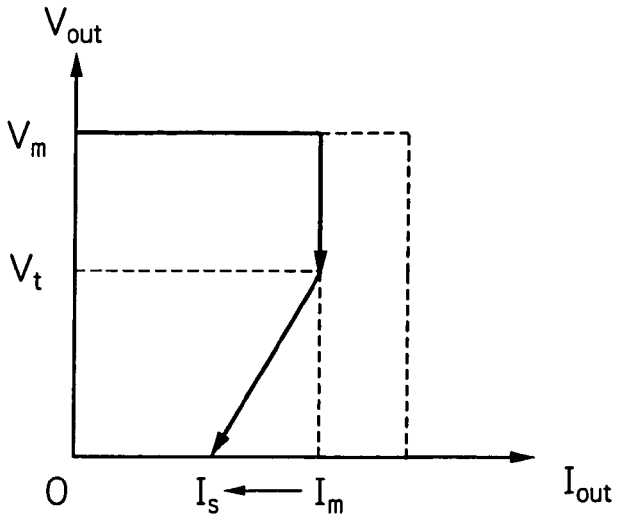
Fig. 2C PRIOR ART
FIG. 2C is a graph for explaining a drooping/fold-back type current limiting characteristic required for the constant voltage generating apparatus of FIG. 1.

In the drooping/fold-back type current limiting characteristic of FIG. 2C, the output voltage $V_{out}$ is the limit voltage $V_m$ before the output current $I_{out}$ reaches the limit current $I_m$. When the output current $I_{out}$ reaches the limit current $I_m$, first, the output voltage $V_{out}$ is forcibly decreased to $V_t$ while the output current $I_{out}$ remains at the limit current $I_m$. Thereafter, the output voltage $V_{out}$ is gradually decreased to 0V, and simultaneously, the output current $I_{out}$ is gradually decreased to the short-circuit current $I_s$.

Figure 3:
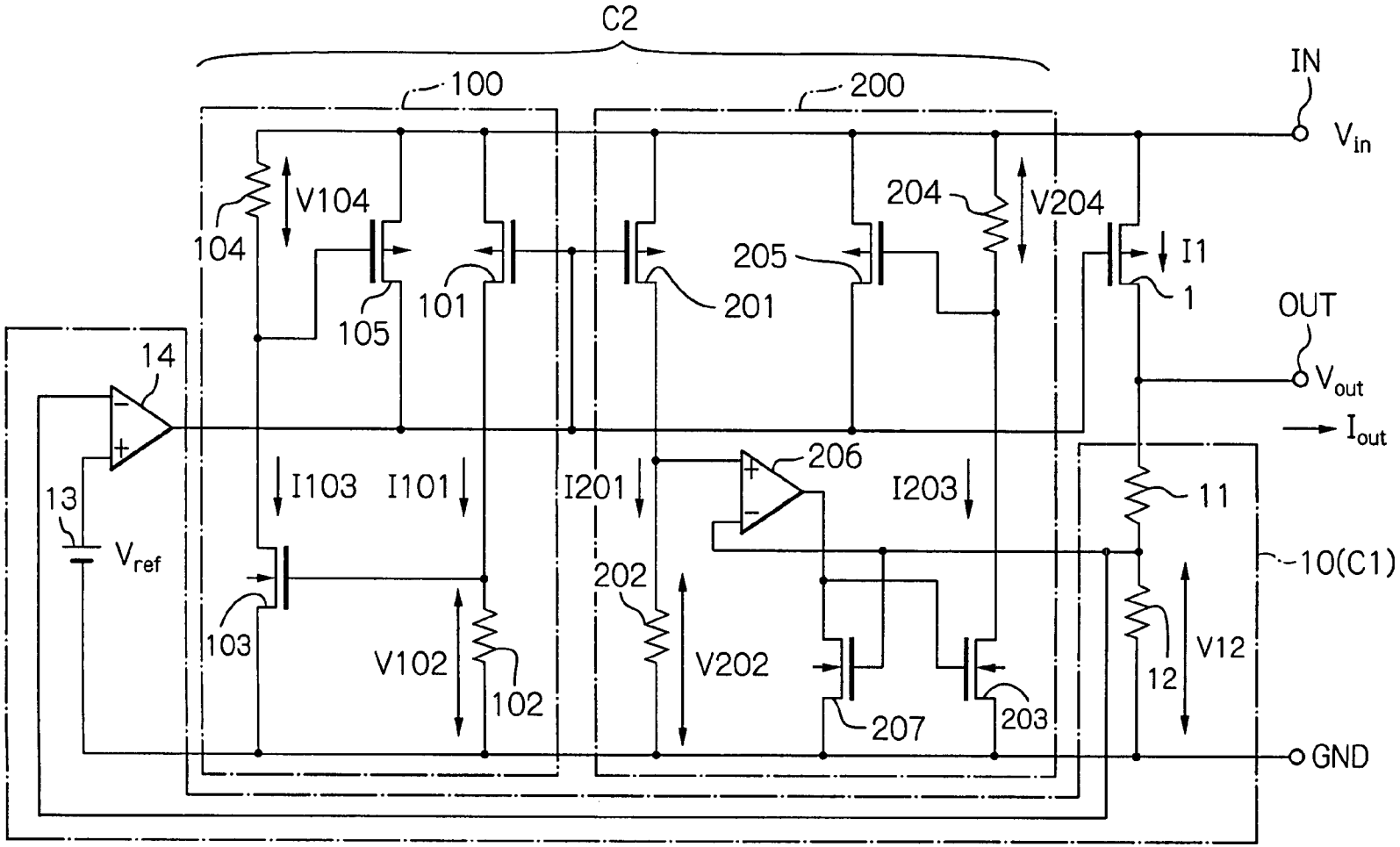
Fig. 3 PRIOR ART
FIG. 3 is a circuit diagram illustrating a second prior art constant voltage generating apparatus.
Figure 4:
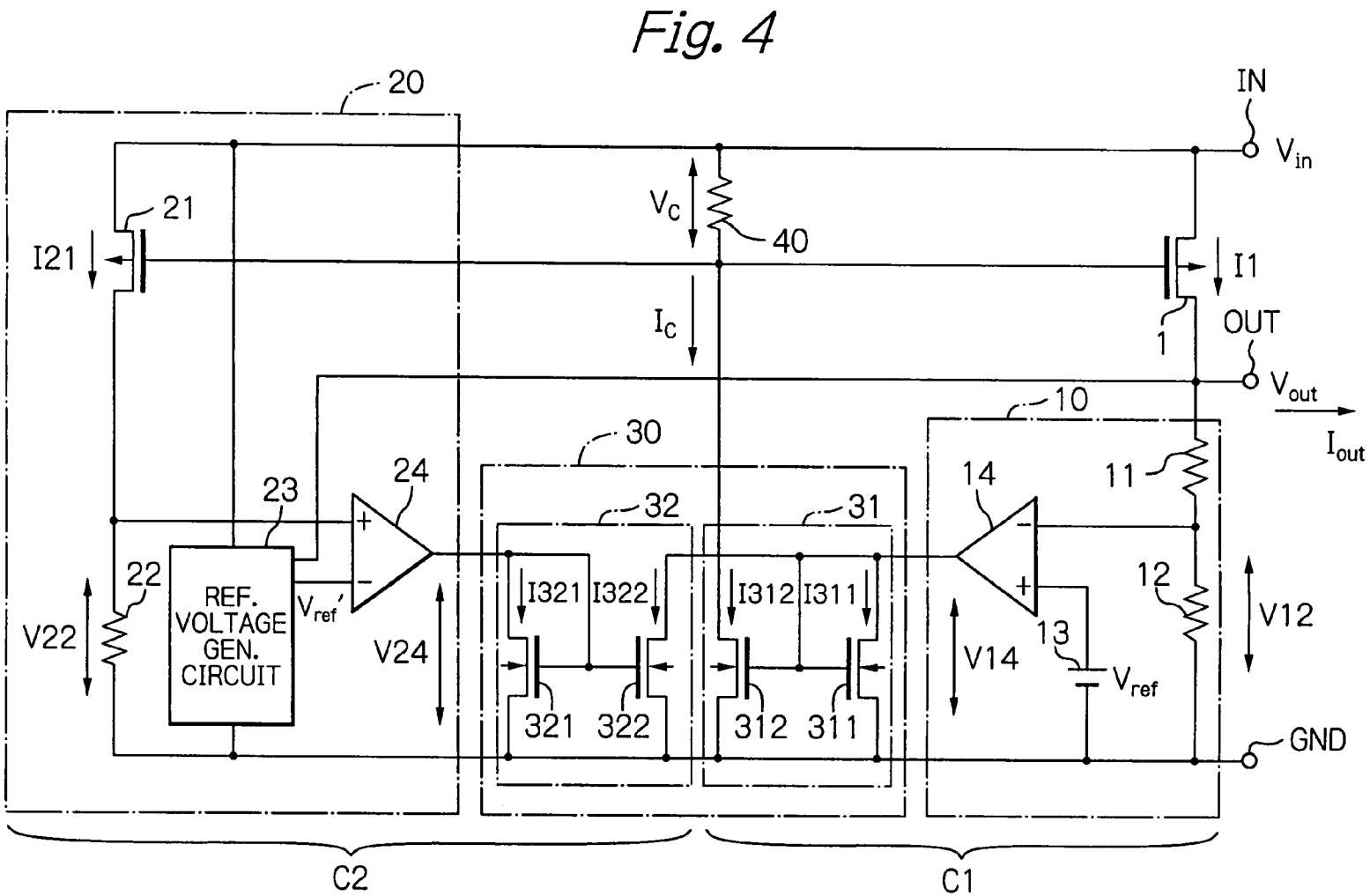
FIG. 4 is a circuit diagram illustrating a first embodiment of the constant voltage generating apparatus according the present invention.

In FIG. 3, which illustrates a second prior art constant voltage generating apparatus (see: FIG. 4 of JP-2002-169618 A), in order to realize the drooping/fold-back type current limiting characteristic of FIG. 2C, a drooping type current limiting circuit 100 and a fold-back type current limiting circuit 200 are added as an overcurrent/short-circuit protection circuit C2 to the elements of FIG. 1.

The drooping type current limiting circuit 100 is constructed by a p-channel MOS transistor 101 forming a mirror circuit with the output MOS transistor 1. Since a current I101 in proportion to the output current $I_{out}$ flows through a resistor 102, a voltage V102 (=I101·R102) is generated in the resistor 102 whose resistance is denoted by R102. When the voltage V102 is larger than a threshold voltage of an n-channel MOS transistor 103, the MOS transistor 103 is turned ON so that a current I103 flows therethrough. Also, since the current I103 flows through a resistor 104, a voltage V104 (=I103·R104) is generated in the resistor 104 whose resistance is denoted by R104. When the voltage V104 is larger than an absolute value of a threshold voltage of a p-channel MOS transistor 105, the MOS transistor 105 is turned ON so that the gate voltage of the output MOS transistor 1 is increased, thus decreasing the output voltage $V_{out}$. In this case, if the threshold voltage of the MOS transistor 103 corresponds to the limit current $I_m$, a drooping current limiting characteristic can be realized.

The fold-back type current limiting circuit 200 is constructed by a p-channel MOS transistor 201 a resistor 202, an n-channel MOS transistor 203, a resistor 204 and a p-channel MOS transistor 205 corresponding to the p-channel MOS transistor 101, the resistor 102, the n-channel MOS transistor 103, the resistor 104 and the p-channel MOS transistor 105, respectively, of the drooping type current limiting circuit 100. Also, the fold-back type current limiting circuit 200 is constructed by a comparator 206 and an n-channel MOS transistor 207.

Since a current I201 in proportion to the output current $I_{out}$ flows through a resistor 202, a voltage V202 (=I201·R202) is generated in the resistor 202 whose resistance is denoted by R202. The voltage V202 of the resistor 202 and the voltage V12 of the resistor 12 are supplied to a non-inverting input and an inverting input of the comparator 206 which has an offset α, so that a voltage of (V202−α) is brought close to V12.

Only when the MOS transistor 203 is turned OFF by the output voltage of the comparator 206, is the control of the output MOS transistor 1 carried out. In other words, when the MOS transistor 203 is turned ON by the output voltage of the comparator 206, the MOS transistor 203 is turned ON, so that the control of the output MOS transistor 1 is not carried out.

In an overload state where V202−α≧V12, the output voltage of the comparator 206 is increased. As a result, when the output voltage of the comparator 206 is larger than a threshold voltage of the MOS transistor 203, the MOS transistor 203 is turned ON to increase a current I203 flowing through the resistor 204, so that a voltage V204 (=I203·R204) is increased in the resistor 204 whose resistance is denoted by R204. When the voltage V204 is larger than an absolute value of a threshold voltage of the MOS transistor 205, the MOS transistor 205 is turned ON so that the gate voltage of the output MOS transistor 1 is also increased, thus decreasing the output voltage $V_{out}$.

Simultaneously, in the above-described overload state, the voltage V12 of the resistor 12 is gradually decreased, so that the output current $I_{out}$ is gradually decreased.

Thus, in the overload state, the output voltage $V_{out}$ and the output current $I_{out}$ are both gradually decreased, which can realize a fold-back (chevron) current limiting characteristic, if the MOS transistor 207 is not provided and the threshold voltage of the MOS transistor 203 corresponds to the limit current $I_m$.

On the other hand, if the MOS transistor 207 is present as illustrated in FIG. 3, when the divided voltage V12 is larger than the threshold voltage of the MOS transistor 207, the MOS transistor 207 is turned ON to turn OFF the MOS transistor 203. Thus, if the threshold voltage of the MOS transistor 207 corresponds to $V_t$, only when the output voltage $V_{out}$ is smaller than $V_t$, are the output voltage $V_{out}$ and the output current $I_{out}$ both gradually decreased, which can realize a drooping/fold-back current limiting characteristic.

In the constant voltage generating apparatus of FIG. 3, however, since the drooping type current limiting circuit 100 is constructed by the elements 101 through 105 and the fold-back type current limiting circuit 200 is constructed by the elements 201 through 205 corresponding to the elements 101 through 205 corresponding to the elements 101 through 105 of the drooping type current limiting circuit 100 as well as the comparator 206 and the MOS transistor 207; in other words, the drooping type current limiting circuit 100 and the fold-back type current limiting circuit 200 are individually provided as an overcurrent/short-circuit protection circuit, the circuit structure is complex, which would increase the manufacturing cost.

Also, since the MOS transistors 105 and 205 are connected to the gate of the output MOS transistor 1, a capacitance connected thereto is increased so that the response characteristics such as a load response characteristic and an oscillation characteristic would deteriorate.

Further, since use is made of a linear region of the MOS transistor 1, the limit current $I_m$ would greatly deteriorate due to the characteristic fluctuation of the MOS transistor 205.

Additionally, when the output MOS transistor 1 is powered ON, the comparator 206 would reverse its output voltage, which would invite an erroneous operation.

Still, even when the MOS transistor 207 is omitted, a complete fold-back (chevron) type current characteristic cannot be obtained.

In FIG. 4, which illustrates a first embodiment of the constant voltage generating apparatus according to the present invention, a current detection signal generating circuit 20, a control current generating circuit 30 and a control current-to-control voltage converting circuit 40 are added to the elements of FIG. 1.

In FIG. 4, the voltage detection signal detecting circuit 10 and the current mirror circuit 31 form a constant voltage control circuit C1, while the current detection signal generating circuit 20 and the current mirror circuit 32 form an overcurrent or short-circuit protection circuit C2. In other words, the current detection signal generating circuit 20 and the current mirror circuit 32 serve as the drooping type current limiting circuit 100 and the fold-back type current limiting circuit 200 of FIG. 3.

The current detection signal generating circuit 20 is constructed by a p-channel MOS transistor 21 forming a current mirror circuit with the output MOS transistor 1, a resistor 22, a reference voltage generating circuit 23 for generating a reference voltage $V_{ref}'$ which is fixed or variable, and a comparator 24 for comparing a voltage V22 in the resistor 22 with the reference voltage $V_{ref}'$ to generate a current detection signal (comparison output) V24.

In more detail, a current I21 in proportion to the output current $I_{out}$ flows through the resistor 22 so that the voltage V22 (=I21·R22) is generated in the resistor 22 whose resistance is denoted by R122. As a result, when V22≧$V_{ref}'$, the current detection signal V24 of the comparator 24 is increased. On the other hand, when V22<$V_{ref}'$, the current detection signal V24 of the comparator 24 is decreased.

The control current generating circuit 30 is constructed by a current mirror circuit 31 connected to the voltage detection signal detecting circuit 10 and a current mirror circuit 32 connected to the current detection signal generating circuit 20.

The current mirror circuit 31 is constructed by an input n-channel MOS transistor 311 connected between the output of the error amplifier 14 and the ground terminal GND, and an output n-channel MOS transistor 312 connected between the control current-to-control voltage converting circuit 40 and the ground terminal GND. The gates of the MOS transistors 311 and 312 are commonly controlled by the voltage detection signal V14 of the error amplifier 14. Therefore, a current I311 in response to the voltage detection signal V14 of the error amplifier 14 flows through the MOS transistor 311, so that a current I312 in response to the current I311 flows through the MOS transistor 312.

The current mirror circuit 32 is constructed by an input n-channel MOS transistor 321 connected between the output of the comparator 24 and the ground terminal GND, and an output n-channel MOS transistor 322 connected between the output of the error amplifier 14 and the ground terminal GND. The gates of the MOS transistors 321 and 322 are controlled by the current detection signal V24 of the comparator 24. Therefore, a current I321 in response to the current detection signal V24 of the comparator 24 flows through the MOS transistor 321, so that a current I322 in response to the current I321 flows through the MOS transistor 322.

The current I322 of the current mirror circuit 32 is also supplied from the current mirror circuit 31. Therefore, the current mirror circuit 32 decreases the currents I311 and I312 of the current mirror circuit 31 to decrease the drive power of the error amplifier 14. That is, if the current flowing through the MOS transistor 312 determined only by the error amplifier 14 is denoted by $I312_0$, $$I312 = I312_0 - I322.$$

Therefore, if the current detection signal V24 is increased, the current I322 is increased so that the current I312 is decreased.

Note that the control current generating circuit 30 generates a control current $I_c$ (=I312).

In other words, the current mirror circuits 31 and 32 are combined with each other so that the control current $I_c$ is determined in accordance with a difference between the output currents of the current mirror circuits 31 and 32.

The control current-to-control voltage converting circuit 40 is constructed by a resistor which generates a control voltage $V_c$ by $$\begin{aligned} V_C &= I_C \cdot R40 \\ &= I312 \cdot R40 \end{aligned}$$

where R40 is a resistance value of the resistor of the circuit 40. The control voltage $V_c$ is supplied to the output MOS transistor 1. For example, when the control current $I_c$ is decreased, the control voltage $V_c$ is decreased to decrease the absolute value of the gate voltage of the output MOS transistor 1. On the other hand, when the control current $I_c$ is increased, the control voltage $V_c$ is increased to increase the absolute value of the gate voltage of the output MOS transistor 1.

The operation of the constant voltage generating apparatus of FIG. 4 is explained next.

First, until the output current $I_{out}$ reaches the limit current $I_m$, the output voltage $V_{out}$ is controlled by the constant voltage control circuit C1 so that the output voltage $V_{out}$ is brought close to the limit voltage $V_m$. In this case, the protection circuit C2 is not operated so that the overcurrent protection or short-circuit protection is not carried out. That is, in the constant voltage control circuit C1, the voltage detection signal (error voltage) V14 is generated by the error amplifier 14. Since no current flows through the current mirror circuit 32, the control current $I_c$, i.e., the control voltage $V_c$ is determined only by the current mirror circuit 31, i.e., the voltage detection signal V14. As a result, the output MOS transistor 1 is controlled by the control voltage $V_c$ so that the output voltage $V_{out}$ is brought close to $V_m$.

In more detail, when $V_{out} \geqq V_m$, the voltage detection signal (error voltage) V14 is decreased to decrease the current I312 ($=I_c$). Thus, the absolute value of gate voltage of the output MOS transistor 1 is increased so that the output voltage $V_{out}$ is decreased. On the other hand, when $V_{out} < V_m$, the voltage detection signal (error voltage) V14 is increased to increase the current I312 ($=I_c$). Thus, the absolute value of gate voltage of the output MOS transistor 1 is decreased so that the output voltage $V_{out}$ is increased.

Next, when the output current $I_{out}$ reaches the limit current $I_m$ defined by the reference voltage $V_{ref}'$, the overcurrent or short-circuit protection circuit C2 is operated. That is, the voltage V22 generated in the resistor 22 by the current I21 in response to the output current I1 flowing through the output MOS transistor 1 reaches the reference voltage $V_{ref}'$ generated from the reference voltage generating circuit 23. As a result, the current detection signal (output voltage) V24 of the comparator 24 is reversed, so that current I322 flows in the current mirror circuit 32 in response to the current detection signal V24. As a result, since the control current I is represented by the current I312 minus the current I322, the control current $I_c$ is decreased so that the control voltage $V_c$ is decreased. Thus, the absolute value of the gate voltage of the output MOS transistor 1 is decreased to limit the output current $I_{out}$.

If the reference voltage $V_{ref}'$ is fixed, i.e., if the limit current $I_m$ is fixed, when the output current $I_{out}$ becomes larger than the limit current $I_m$, the output current $I_{out}$ is always guarded by the limit current $I_m$, so that the drooping type current limiting characteristic as shown in FIG. 2A is obtained.

If the reference voltage $V_{ref}'$ is variable and is decreased as the output voltage $V_{out}$ is decreased, i.e., if the limit current $I_m$ is decreased as the output voltage $V_{out}$ is decreased, when the output current $I_{out}$ becomes larger than the limit current $I_m$, the output current $I_{out}$ is gradually decreased to $I_s$ as the output voltage $V_{out}$ is gradually decreased to 0V, so that the fold-back (chevron) type current limiting characteristic as shown in FIG. 2B is obtained.

If the reference voltage $V_{ref}'$ is first fixed, and then, the reference voltage $V_{ref}'$ is variable and is decreased as the output voltage $V_{out}$ is decreased, i.e., if the limit current $I_m$ is first fixed, and then the limit current $I_m$ is decreased as the output voltage $V_{out}$ is decreased, when the output current $I_{out}$ becomes larger than the limit current $I_m$, the output current $I_{out}$ is first fixed, and then is gradually decreased to $I_s$ as the output voltage $V_{out}$ is gradually decreased to 0V, so that the drooping/fold-back type current limiting characteristic as shown in FIG. 2C is obtained.

The reference voltage generating circuit 23 of FIG. 4 is explained next with reference to FIG. 5A and 5B.

Figures 5A, 5B:
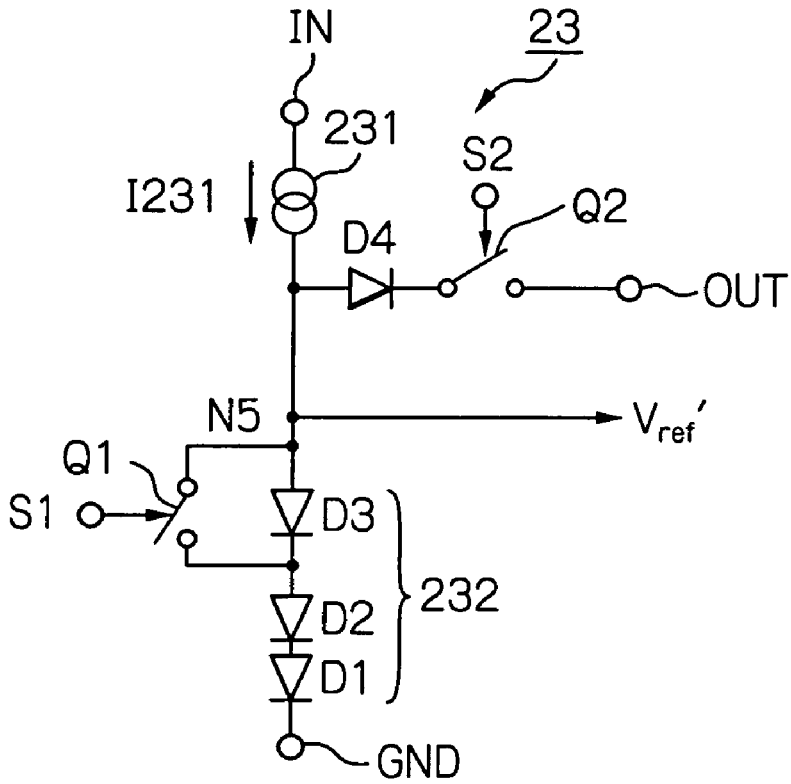
FIG. 5A is a detailed circuit diagram of the reference voltage generating circuit of FIG. 4.
FIG. 5B is a table for explaining the operation of the reference voltage generating circuit of FIG. 5A.

In FIG. 5A, which is a detailed circuit diagram of the reference voltage generating circuit 23 of FIG. 4, the reference voltage generating circuit 23 is constructed by a constant current source 231 where a constant current I231 flows therethrough and a diode circuit 232 formed by diodes D1, D2 and D3 connected in series between the input terminal IN and the ground terminal GND, and a diode D4 connected between a node N5 of the constant current source 231 and the diode circuit 232 and the output terminal OUT. In this case, the cathode of the diode D1 is connected to the ground terminal GND, the cathode of the diode D2 is connected to the anode of the diode D1, the cathode of the diode D3 is connected to the anode of the diode D2, the anode of the diode D3 is connected to the node N5, the anode of the diode D4 is connected to the node N5, and the cathode of the diode D4 is connected to the switch Q2. The node N5 is adapted to generate the reference voltage $V_{ref}'$. Note that the number of diodes in the diode circuit 232 can be 2, 4, 5, . . . . Also, the switch Q2 can be connected between the node N5 and the anode of the diode D4.

For example, the switches Q1 and Q2 are formed by N-channel MOS transistors whose gate voltages are controlled by voltages at electrodes (pads) S1 and S2, respectively.

As indicated by I in FIG. 5B, when the switches Q1 and Q2 are both turned OFF, the reference voltage $V_{ref}'$ is fixed by the diodes D1, D2 and D3. In this case, the fixed value of the reference voltage $V_{ref}'$ corresponds to the limit current $I_m$ of FIG. 2A, i.e., the limit voltage $V_m$, so that the drooping type current limiting characteristic as shown in FIG. 2A can be obtained.

As indicated by II in FIG. 5B, when the switches Q1 and Q2 are turned OFF and ON, respectively, the reference voltage $V_{ref}'$ depends upon the output voltage $V_{out}$. In this case, if the reference voltage $V_{ref}'$ is determined by the constant current source 231 and the diode circuit 232 to be $V_m$, the reference voltage $V_{ref}'$ is gradually decreased immediately after the output voltage $V_{out}$ is gradually decreased, if the forward voltage of the diode D4 is neglected. Thus, the fold-back (chevron) type current limiting characteristic as shown in FIG. 2B can be obtained.

As indicated by III in FIG. 5B, when the switches Q1 and Q2 are both turned ON, the reference voltage $V_{ref}'$ also depends upon the output voltage $V_{out}$. In this case, the reference voltage $V_{ref}'$ determined by the constant current source 231 and the diode circuit 232 is lower than $V_m$, i.e., $V_t$, so that the reference voltage $V_{ref}'$ is gradually decreased as the output voltage $V_{out}$ is gradually decreased, after the output voltage $V_{out}$ reaches $V_t$. Also, the forward voltage of the diode D4 is neglected. Thus, the drooping/fold-back type current limiting characteristic as shown in FIG. 2C can be obtained.

Thus, in the first embodiment as illustrated in FIGS. 4, 5A and 5B, the output voltage $V_{out}$ is controlled to the limit voltage $V_m$ by the constant voltage control circuit C1 formed by the voltage detection signal generating circuit 10 and the current mirror circuit 31, and the control current-to-control voltage converting circuit 40. On the other hand, the output current $I_{out}$ is guarded at the limit current $I_m$ by the overcurrent or short-circuit protection circuit C2 formed by the current detection signal generating circuit 20 and the current mirror circuit 32. The control of the constant voltage and the control of the overcurrent or short-circuit protection are carried out commonly by the control current generating circuit 30. Thus, the circuit structure can be simplified as compared with the prior art of FIG. 3 where the drooping type current limiting circuit 100 and the fold-back type current limiting circuit 200 are individually provided.

Also, in the first embodiment as illustrated in FIGS. 4, 5A and 5B, three kinds of current limiting characteristics can be obtained by controlling the switches Q1 and Q2.

Further, in the first embodiment as illustrated in FIGS. 4, 5A and 5B, since the gate voltage of the output MOS transistor 1 is controlled by an I/V conversion using the resistor of the control voltage-to-control voltage converting circuit 40, not by the MOS transistors, the gate capacitance of the output MOS transistor 1 can be decreased, which would improve the response characteristic including the response speed of the current limiting characteristic. Additionally, the control current $I_m$ can be easily set by changing the resistance value of the resistor of the control current-to-control voltage converting circuit 40. Still, since the fluctuation of the resistance value of the resistor of the control current-to-control voltage converting circuit 40 can be smaller than that of linear regions of MOS transistors, the fluctuation of the limit current $I_m$ can be suppressed.

Figure 6:
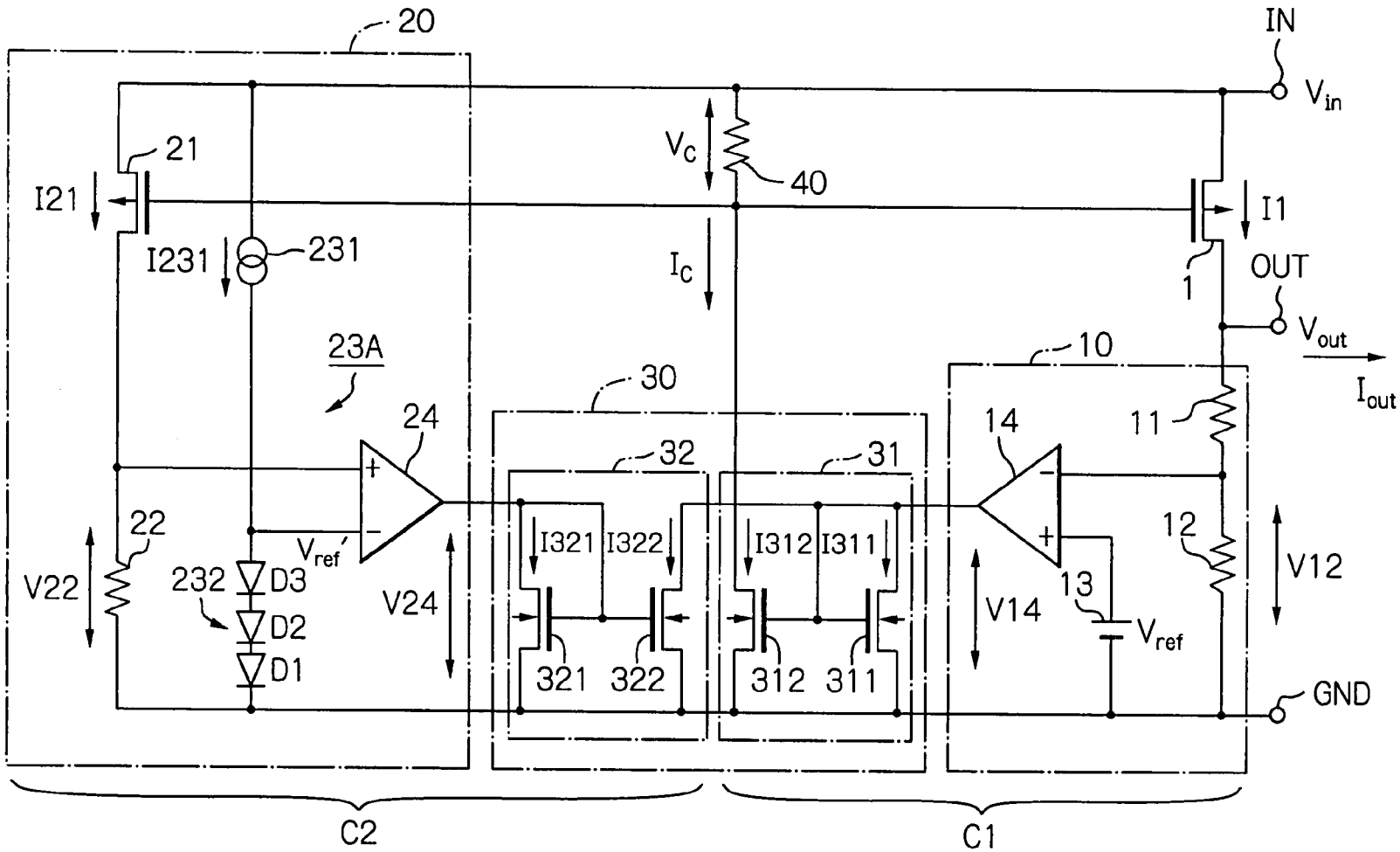
FIG. 6 is a circuit diagram illustrating a second embodiment of the constant voltage generating apparatus according the present invention.

In FIG. 6, which illustrates a second embodiment of the constant voltage generating apparatus according to the present invention, a reference voltage generating circuit 23A is constructed by the constant current source 231 and the diode circuit 232 formed by the diodes D1, D2 and D3 of FIG. 5A. In this case, the drooping type current limiting characteristic as shown in FIG. 2A can be obtained.

Figure 7:
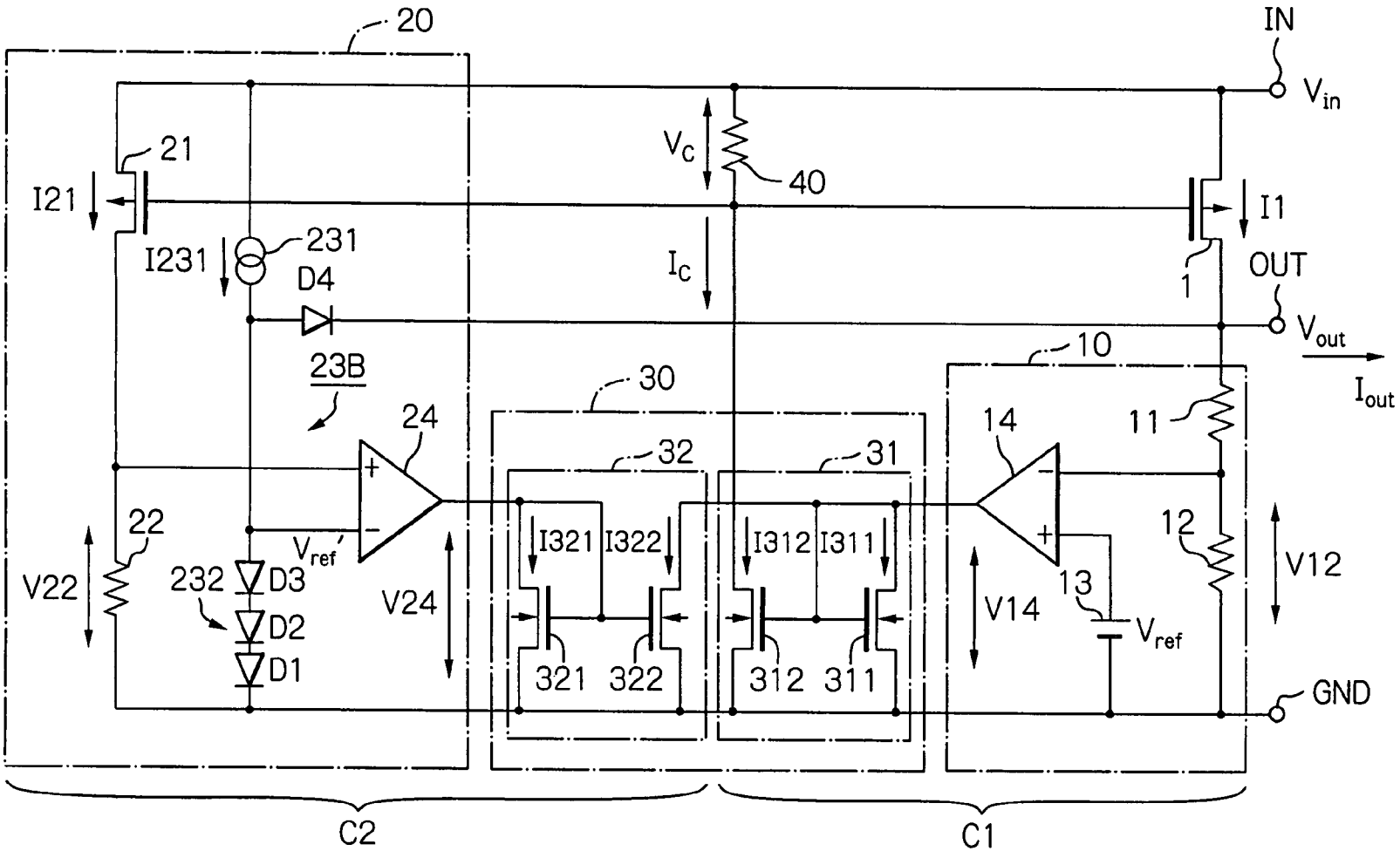
FIG. 7 is a circuit diagram illustrating a third embodiment of the constant voltage generating apparatus according the present invention.

In FIG. 7, which illustrates a third embodiment of the constant voltage generating apparatus according to the present invention, a reference voltage generating circuit 23B is constructed by the constant current source 231 and the diode circuit 232 formed by the diodes D1, D2 and D3, and the diode D4 of FIG. 5A. In this case, the fold-back (chevron) type current limiting characteristic as shown in FIG. 2B can be obtained.

Figure 8:
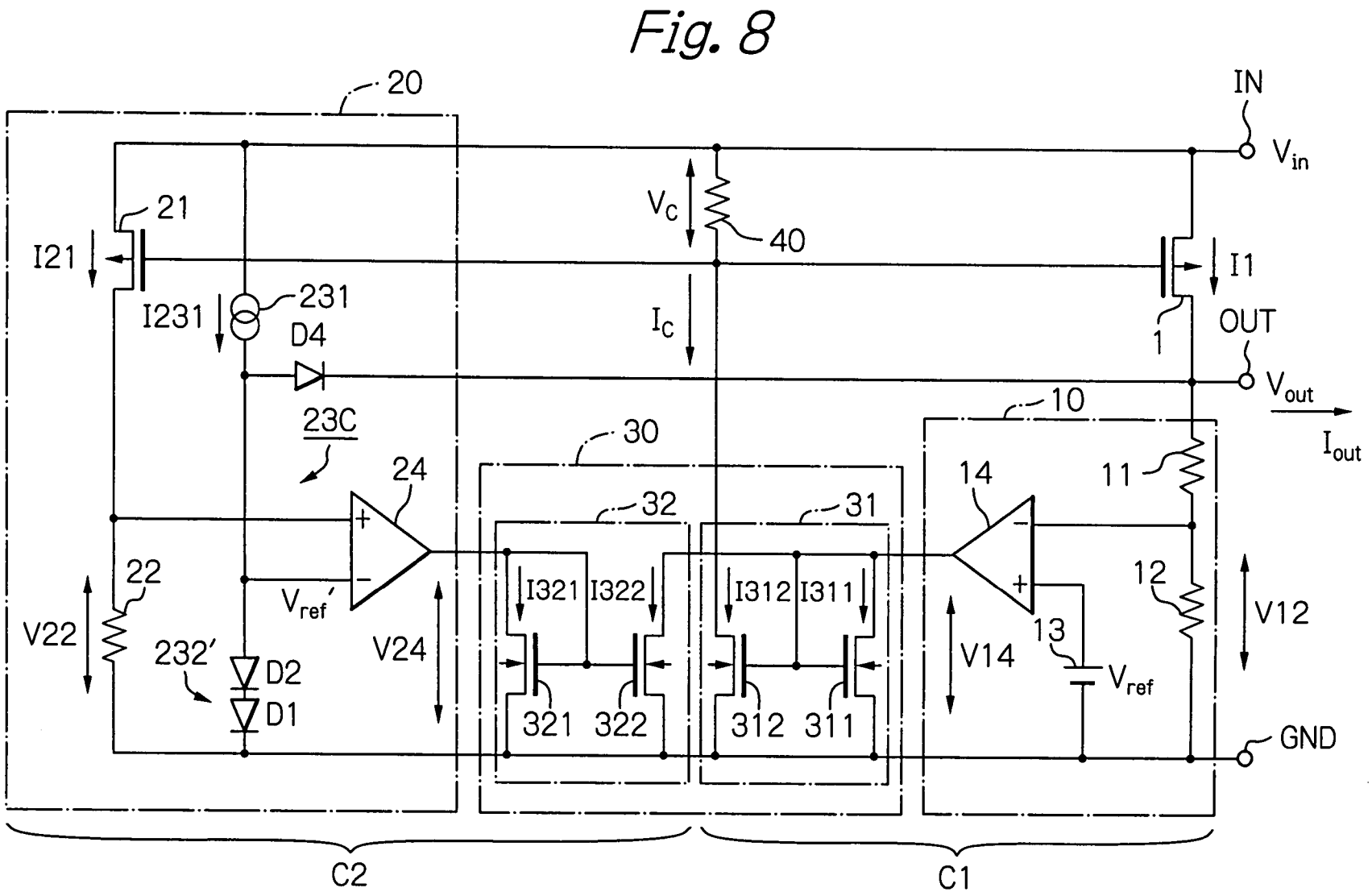
FIG. 8 is a circuit diagram illustrating a fourth embodiment of the constant voltage generating apparatus according the present invention.

In FIG. 8, which illustrates a fourth embodiment of the constant voltage generating apparatus according to the present invention, a reference voltage generating circuit 23C is constructed by the constant current source 231 and a diode circuit 232' formed by the diodes D1 and D2, and the diode D4 of FIG. 5A. In this case, the drooping/fold-back type current limiting characteristic as shown in FIG. 2C can be obtained.

In the above-described first embodiment where the switch Q2 is turned ON, and in the third and fourth embodiments, even when the output terminal OUT is short-circuited to the ground terminal GND, the output current $I_{out}$ is forcibly decreased to the short-circuit current $I_s$, thus detecting a short-circuit state. Also, when the power is turned ON to increase the output voltage $V_{out}$, a current I223 is supplied immediately from the constant current source 231 to the diode circuit 232 (232') and to the diode D4 due to the fact that the output voltage $V_{out}$ is sufficiently low. At this time, since the output current $I_{out}$ is also sufficiently low, the current I21 flowing through the MOS transistor 21 is so small that the voltage V22 is surely lower than the reference voltage $V_{ref}'$. As a result, in an initial state after the power is turned ON, the output state of the comparator 24 is never reversed, thus avoiding an erroneous operation.

In the above-described embodiments, the conductivity type of the MOS transistors can be changed, and also, bipolar transistors can be used instead of the MOS transistors.

As explained hereinabove, according to the present invention, the circuit structure can be simplified to decrease the manufacturing cost, and the response characteristics can be improved.

The invention claimed is:

1. A constant voltage generating apparatus, comprising:

an output circuit controlled in accordance with a control voltage;

a voltage detection signal generating circuit adapted to generate a voltage detection signal in accordance with a difference between an output voltage signal of said output circuit and a first reference signal;

a current detection signal generating circuit adapted to generate a current detection signal in accordance with a difference between an output current signal of said output circuit and a second reference signal;

a control current generating circuit adapted to generate a control current in accordance with said voltage detection signal and said current detection signal; and a control current-to-control voltage converting circuit adapted to convert said control current into said control voltage, wherein said control current generating circuit comprises:

a first current mirror circuit adapted to generate a first current in accordance with said voltage detection signal; and a second current mirror circuit adapted to generate a second current in accordance with said current detection signal, said first and second current mirror circuits being combined with each other so that said control current is determined in accordance with a difference between said first and second currents.

2. The constant voltage generating apparatus as set forth in claim 1, wherein said voltage detection signal generating circuit comprises:

a first detection voltage generating circuit adapted to generate a first detection voltage in accordance with the output voltage signal of said output circuit; and an error amplifier adapted to amplify a difference between said first detection voltage and said first reference signal to generate said voltage detection signal in accordance with said difference.

3. The constant voltage generating apparatus as set forth in claim 2, wherein said voltage detection signal generating circuit further comprises a voltage divider adapted to divide the output voltage signal of said output circuit to generate said first detection voltage.

4. The constant voltage generating apparatus as set forth in claim 2, wherein said voltage detection signal generating circuit further comprises a reference voltage source adapted to generate a definite voltage as said first reference signal.

5. The constant voltage generating apparatus as set forth in claim 1, wherein said current detection signal generating circuit comprises:

a second detection voltage generating circuit adapted to generate a second detection voltage in accordance with the output current signal of said output circuit; and a comparator adapted to compare said second detection voltage with said second reference signal to generate said current detection signal.

6. The constant voltage generating apparatus as set forth in claim 5, wherein said second detection voltage generating circuit comprises:

a circuit that forms a current mirror circuit with said output circuit to generate a detection current in response to the output current signal of said output circuit; and a resistor adapted to convert said detection current into said second detection voltage.

7. The constant voltage generating apparatus as set forth in claim 5, wherein said current detection signal generating circuit further comprises a reference voltage generating circuit adapted to generate said second reference signal.

8. The constant voltage generating apparatus as set forth in claim 7, wherein said reference voltage generating circuit generates one of a definite voltage, and first and second variable voltages, said definite voltage corresponding to a limit current of the output current signal of said output circuit, said first variable voltage being decreased immediately after the output voltage signal of said output circuit is decreased from a limit voltage, said second variable voltage being decreased after the output voltage signal of said output circuit is decreased from a voltage lower than said limit voltage.

9. The constant voltage generating apparatus as set forth in claim 7, wherein the reference voltage generating circuit comprises:

a constant current source;

a diode circuit including first, second, and third diodes connected in series between an input terminal and a ground terminal; and a fourth diode connected between a node of the constant current source and the diode circuit and an output terminal.

10. The constant voltage generating apparatus as set forth in claim 9, further comprising a first switch connected between the anode of the third diode a cathode of the third diode and a second switch, wherein a cathode of the first diode is connected to the ground terminal, wherein a cathode of the second diode is connected to an anode of the first diode, wherein the cathode of the third diode is connected to an anode of the second diode, wherein an anode of the fourth diode is connected to the switch node, and wherein a cathode of the fourth diode is connected to the second switch connected between the switch node and the anode of the fourth diode.

11. The constant voltage generating apparatus as set forth in claim 10, wherein when the first switch and the second switch are both turned OFF, the reference voltage is fixed by the first, second, and third diodes, and wherein, when the first switch is turned OFF and the second switch is turned ON, the reference voltage depends upon the output voltage, and wherein, when the first and second switches are both turned ON, the reference voltage depends upon the output voltage.

12. The constant voltage generating apparatus as set forth in claim 1, wherein said control current-to-control voltage converting circuit comprises a resistor.

13. A constant voltage generating apparatus, comprising:

first and second power supply terminals;

an output terminal;

an output transistor connected between said first power supply terminal and said output terminal;

a voltage divider connected between said output terminal and said second power supply terminal and adapted to generate a divided voltage;

an error amplifier connected to said voltage divider and adapted to amplify an error between said divided voltage and a definite reference voltage to generate a voltage detection signal;

a first current detection transistor connected to said first power supply terminal and forming a current mirror circuit with said output transistor;

a first current-to-voltage converting resistor connected to said first current detection transistor and adapted to generate a current detection voltage;

a variable reference voltage generating circuit adapted to generate a variable reference voltage depending upon an output voltage at said output terminal;

a comparator with a first input terminal connected to said first current-to-voltage converting resistor and a second input terminal connected to said variable reference voltage generating circuit, and adapted to compare said current detection voltage with said variable reference voltage to generate a current detection signal;

a second current detection transistor connected between an output of said error amplifier and said second power supply terminal;

a third current detection transistor connected between a control terminal of said output transistor and said second power supply terminal and forming a current mirror circuit with said second current detection transistor;

a fourth current detection transistor connected between an output of said comparator and said second power supply terminal;

a fifth current detection transistor connected between the output of said comparator and said second power supply terminal and forming a current mirror circuit with said fourth current detection transistor; and a second current-to-voltage converting resistor connected between said first power supply terminal and the control terminal of said output transistor.

14. The constant voltage generating apparatus as set forth in claim 13, wherein said definite reference voltage corresponds to a limit voltage at said output terminal.

15. The constant voltage generating apparatus as set forth in claim 13, wherein said variable reference voltage generating circuit comprises:

a constant current source connected between said first power supply terminal and the second input of said comparator;

a first diode circuit connected between the second input of said comparator and said second power supply terminal; and a second diode circuit connected between said output terminal and the second input of said comparator.

16. The constant voltage generating apparatus as set forth in claim 15, wherein said first and second diode circuits are determined so that said variable reference voltage is decreased immediately after an output voltage at said output terminal is decreased from a limit voltage at said output terminal.

17. The constant voltage generating apparatus as set forth in claim 15, wherein said first and second diode circuits are determined so that said variable reference voltage is decreased after an output voltage at said output terminal is decreased from a voltage smaller than a limit voltage at said output terminal.

18. A constant voltage generating apparatus comprising:

first and second power supply terminals;

an output terminal;

an output transistor connected between said first power supply terminal and said output terminal;

a voltage divider connected between said output terminal and said second power supply terminal and adapted to generate a divided voltage;

an error amplifier connected to said voltage divider and adapted to amplify an error between said divided voltage and a first definite reference voltage to generate a voltage detection signal;

a first current detection transistor connected to said first power supply terminal and forming a current mirror circuit with said output transistor;

a first current-to-voltage converting resistor connected to said first current detection transistor and adapted to generate a current detection voltage;

a comparator connected to said first current-to-voltage converting resistor and adapted to compare said current detection voltage with a second definite voltage to generate a current detection signal;

a second current detection transistor connected between an output of said error amplifier and said second power supply terminal;

a third current detection transistor connected between a control terminal of said output transistor and said second power supply terminal and forming a current mirror circuit with said second current detection transistor;

a fourth current detection transistor connected between an output of said comparator and said second power supply terminal;

a fifth current detection transistor connected between the output of said comparator and said second power supply terminal and forming a current mirror circuit with said fourth current detection transistor; and a second current-to-voltage converting resistor connected between said first power supply terminal and the control terminal of said output transistor.

19. The constant voltage generating apparatus as set forth in claim 18, wherein said first and second definite reference voltages correspond to a limit voltage and a limit current, respectively, at said output terminal.

* * * * *